US005213291A

United States Patent [19]

Wiebe

[11] Patent Number: 5,213,291

[45] Date of Patent: May 25, 1993

[54] GARBAGE BAG HOLDER

[76] Inventor: Jacob R. Wiebe, 60 Heaton Avenue, Winnipeg, Manitoba, Canada, R3B 3E3

[21] Appl. No.: 751,816

[22] Filed: Aug. 30, 1991

[51] Int. Cl.[5] ..... A63B 55/04

[52] U.S. Cl. ..... 248/97; 248/98; 280/47.34

[58] Field of Search ..... 248/97, 98; 280/87.01, 280/79.11, 79.2, 651, 47.34

[56] References Cited

U.S. PATENT DOCUMENTS

| | | | |
|---|---|---|---|
| 993,964 | 5/1911 | Davis | 248/98 |
| 2,470,977 | 5/1949 | Chidsey, Jr. | 248/97 |
| 2,679,302 | 5/1954 | Watson et al. | 280/47.34 X |
| 3,161,391 | 12/1964 | Bahnsen | 248/99 |
| 3,318,453 | 5/1967 | Cavanagh | 211/42 X |
| 3,614,042 | 10/1971 | Jensen | 248/97 |
| 3,806,146 | 4/1974 | Shaw | 248/98 X |
| 3,826,455 | 7/1974 | O'Donnell | 248/97 |
| 4,354,543 | 10/1982 | Bogner | 248/98 X |
| 4,469,300 | 9/1984 | Valesko | 248/97 |
| 4,802,647 | 2/1989 | Celmayster et al. | 248/97 X |
| 4,893,769 | 1/1990 | Rotelli | 248/97 |
| 4,921,193 | 5/1990 | Benesch | 248/97 |
| 5,062,871 | 11/1991 | Lemon, III | 248/98 X |
| 5,099,951 | 3/1992 | Stockwell | 182/20 |

*Primary Examiner*—David A. Scherbel
*Assistant Examiner*—Korie H. Chan
*Attorney, Agent, or Firm*—Adrian D. Battison; Stanley G. Ade; Murray E. Thrift

[57] ABSTRACT

A garbage bag holder of the type manufactured from a wire frame for receiving the mouth of a garbage bag which is wrapped over the wire frame into an open position to receive garbage or other material. The wire frame is symmetrical so that the bag holder is operable in an inverted position. The wire frame has legs bent relative to the bottom bars at an angle greater than 90 degrees such that flexing of the legs are required during installation of a garbage bag over the wire frame.

10 Claims, 4 Drawing Sheets

GARBAGE BAG HOLDER

BACKGROUND OF THE INVENTION

This invention relates to a garbage bag holder of a type manufactured from a wire frame for receiving the mouth of a garbage bag wrapped over the wire frame and holding the bag open for receiving garbage or other materials.

Very large number of designs of garbage bag holder have been proposed over the years but very few of these have received any commercial success as they have failed to achieve the requirements of simplicity, economical manufacture, attractiveness and the ability to hold the bag in an effective manner.

Examples are shown in U.S. Pat. Nos. 4,667,912 (DeVilbiss); 3,633,859 (Vosbikian); 3,095,172 (Dwyer); 4,364,534 (Valesko); 4,175,602 (Cavalaris et al); 4,893,769 (Rotelli); 4,802,647 (Celmayster et al). A further example is shown in a mail order catalogue of Chiswick.

In many of the examples shown above, those provide a pair of upstanding bag supporting elements in the form of U-shaped hoops which are inverted to define a cross bar which engages the mouth of the bag and depending legs. The legs are then connected together by various coupling elements to simply the U-shaped member in the vertical orientation with the cross bars at the top of the U-shaped member spaced and parallel. The bag is then simply draped over the cross bars to define a square opening at the mouth of the bag. However many of these designs are ineffective for one or more of the above reasons. In particular the support for the bag is relatively loose so that the bag is not effectively supported. In addition the construction is relatively complex involving extra parts and connections at the coupling point between the legs and the base.

SUMMARY OF THE INVENTION

It is one object of the present invention, therefore, to provide an improved garbage bag holder of the above general type but which provides an attractive appearance, an economic construction and a device which effectively supports the bag.

According to the invention, therefore, there is provided a garbage bag holder comprising a wire frame shaped and connected to define a continuous wire element including two spaced upstanding bag engaging portions each shaped generally as an inverted U-shape with an upper cross bar and two depending legs, the cross bars being in spaced generally parallel locations so that an edge of the bag at an open mouth of the bag can be wrapped over the cross bars to hold the mouth open, and two bottom bars, each connecting a lowermost end of one leg of one of the bag engaging portions to a lowermost end of an adjacent one of the legs of the other bag engaging portion thus defining four connecting portions each between a respective leg and the respective bottom bar, each of the connecting portions being defined by an integral portion of the wire forming the leg and the bottom bar thus allowing spring flexing of the legs relative to the bottom bars to bias the cross bars apart to stretch the mouth of the bag.

The spring connection between the legs and the bottom bars therefore allows the U-shaped members and the cross bars to be sprung apart to hold the bag in a stretched condition.

Preferably the device is entirely symmetrical so that it can be inverted with the bottom bars then defining the cross bars in the inverted orientation.

Preferably each of the legs is canted outwardly at an upper portion adjacent the cross bar so that the spacing of the cross bar is increased to improve the tension at the top of the bag.

In one embodiment the device is formed of a complete continuous wire welded at abuting ends. In a second embodiment the device is formed from four U-shaped members which are connected at central points of the legs by connector members so that the whole device can be collapsed for packaging in flat form.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
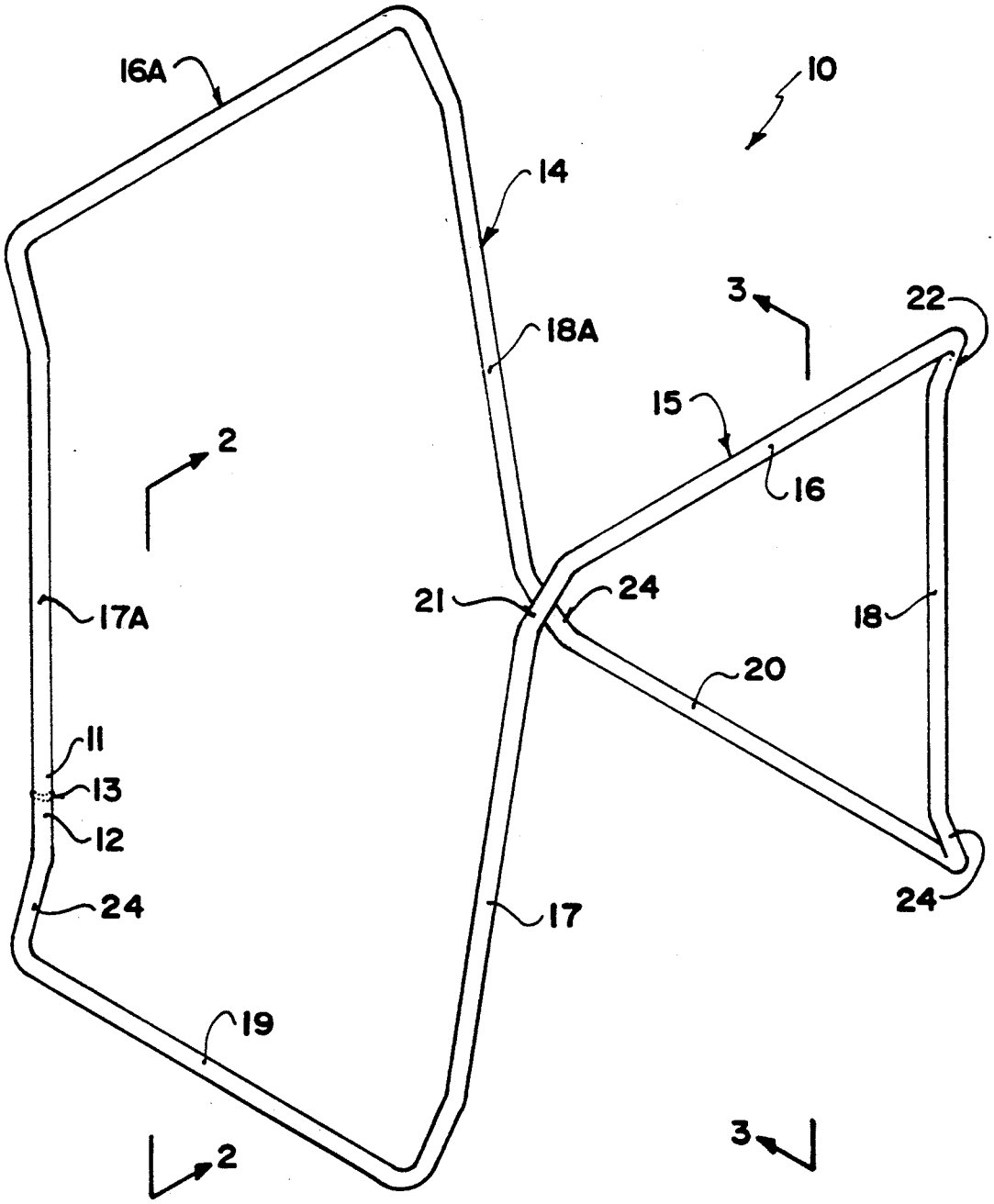
FIG. 1 is an isometric view of the bag holder with a bag removed.

The bag holder generally shown in FIG. 1 comprises a wire element 10 formed as a continuous loop of the wire with two abuting ends 11 and 12 welded together at a weld line 13 so the wire element is fully continuous. The wire element is bent to form two upstanding bag support portions 14 and 15 each of which is generally an inverted U-shape with a cross bar 16 and legs 17 and 18 depending from ends of the cross bar 16. The lower ends of the legs 17 and 18 are connected to bottom bars 19 and 20 which connect the lower ends of the legs to the lower ends of the legs of the bag support portion 14. Thus the bottom bar 19 connects the lower end of the leg 17 to the lower end of the leg 17A which is the adjacent leg of the bag support portion 14. Similarly the lower end of the leg 18 is connected to the lower end of the leg 18A.

The coupling between the lower end of the legs and the bottom bars 19 and 20 is defined by an integral portion of the wire so that the legs can flex relative to the bottom bar by bending of the wire both at the coupling and in the length of the wire forming the bottom bar of the legs themselves to provide a spring action of the holder.

A short portion of each of the legs 17 and 18 as indicated at 21 and 22 immediately adjacent the cross bar 16 is cranked outwardly away from the other of the bag support portion. This shape is shown more clearly in FIG. 2 where the upper end of the leg 17 is cranked outwardly at 21 and the upper end of the leg 17A is cranked outwardly at 21A. This causes the spacing between the cross bar 16 relative to the cross bar 16A to be increased relative to the spacing between the upper parts of the leg 17 and 17A.

Figure 2:
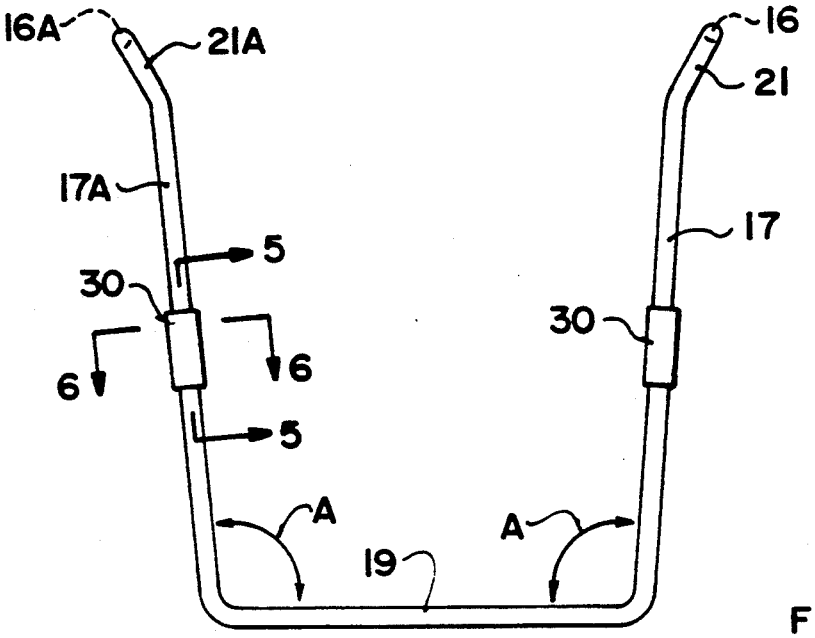
FIG. 2 is side elevational view generally along the lines 2—2 of FIG. 1 but showing a modified arrangement.
Figure 3:
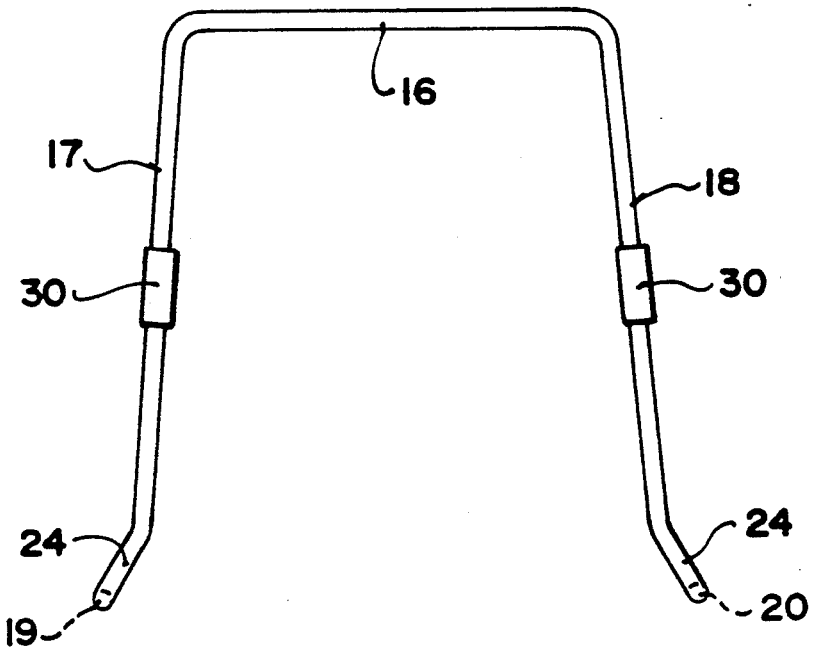
FIG. 3 is a side elevational view generally along the lines 3—3 of FIG. 1 but again showing the modified arrangement.

Again as shown in FIG. 2, the legs 17 and 17A are arranged at an angle A relative to the bottom bar 19 which is slightly greater than 90° so that the legs 17 and 17A are inclined upwardly and outwardly so as to gradually increase the spacing therebetween. The angle is preferably of the order of 95°.

The wire element is formed symmetrically so that the dimensions of the cross bar 16 and 16A are identical to the dimensions of the bottom bars 19 and 20 allowing the whole unit to be inverted in which case it will operate in exactly the same manner with the bottom bars 16 and 16A resting upon the ground and supporting the element. Thus the lower ends of the legs 17, 18, 17A and 18A are cranked outwardly as indicated at 24 in a symmetrical manner to the portions 21 and 22 and the top end of the legs. The whole device is therefore entirely symmetrical and can be inverted.

Figure 4:
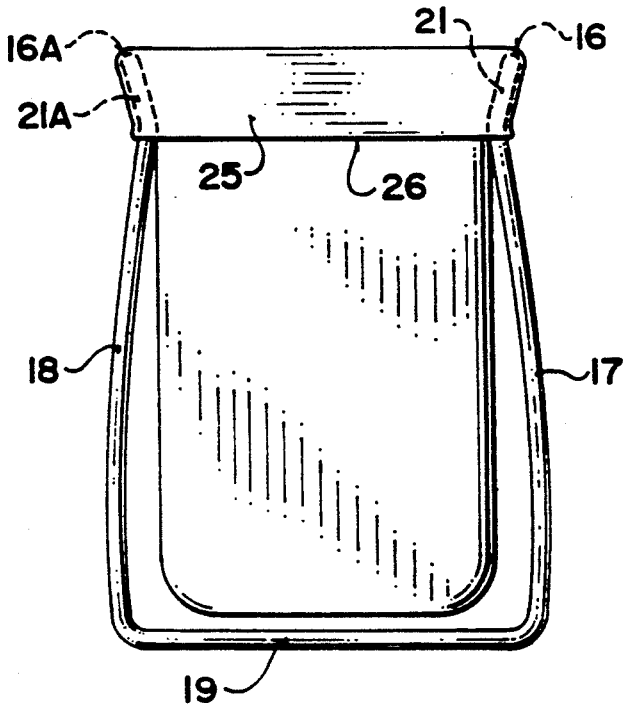
FIG. 4 is a side elevational view similar to that of FIG. 2 showing a bag attached to the bag holder.
Figure 5:
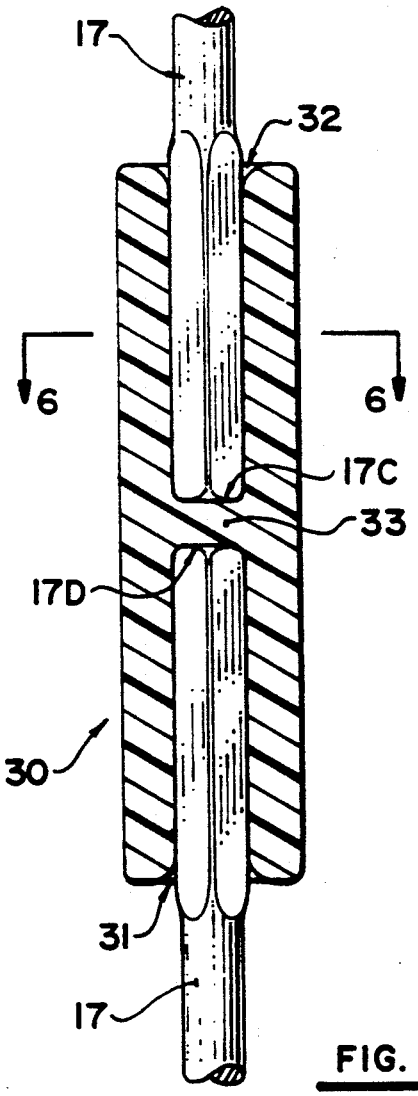
FIG. 5 is a cross sectional view along the lines 5—5 of FIG. 2.

In operation as shown in FIG. 4, the cross bar 16 and 16A are pulled together manually so the spacing therebetween is decreased causing a flexing of the wire element through the coupling between the bottom bars in the legs and in the legs themselves. In the retracted position, a bag can be wrapped over the cross bar 16 and 16A so that the open mouth has a turn back portion 25 wrapped over the cross bars to extend downwardly over the portions 21 and 21A. The remainder of the bag hangs down inwardly of the legs. The length of the legs is selected relative to the size of the bag so that the bag is supported just off the ground or with its bottom just in contact with the ground to hold the majority of the bag open. The spring action of the legs and the connections between the legs and the bottom bars pulls the bag open to tension the mouth of the bag into a rectangular shape with sides defined by the cross bars and the sides at right angles thereto unsupported by bars but tensioned by the spring action between the cross bars. The outwardly cranked portions 21 and 21A act to further tension the bag at its point of contact with the cross bar 16 and 16A since this point is the maximum spaced point. It is also spaced from the edge 26 of the bag so as to prevent the possibility of tearing or slitting the bag since a slit will normally start only at the edge of the bag.

Figure 6:
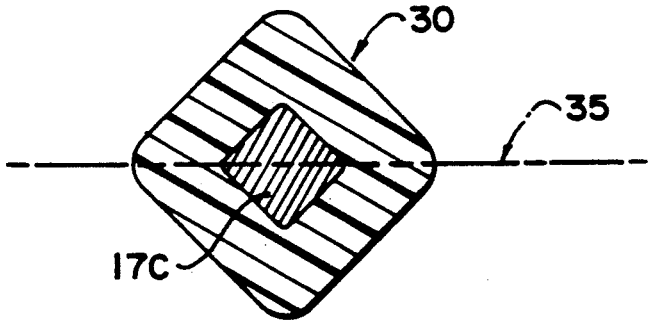
FIG. 6 is a cross-sectional view along the lines 6—6 of FIG. 2.

Turning now to FIGS. 2, 3, 5 and 6, an alternative arrangement is shown in place of the continuous wire loop of FIG. 1. In this embodiment the continuous wire loop is formed by four separate U-shaped elements connected together at coupling members 30. The coupling members 30 are shown in more detail in FIGS. 5 and 6 and each comprises a sleeve member with opposed bores 31 and 32 for receiving abutting ends 17C and 17D of the leg 17. Thus the leg 17 is split into two parts with the coupling member reconnecting the leg to define a complete continuous leg. The sleeve member is formed of a plastics material preferably injection molded with an abutment section 33 at a centre to define the bores 31 and 32 into separate lengths to prevent the sleeve member from sliding longitudinally to the leg. The outside dimension and shape of the coupling member 30 is unimportant simply providing enough thickness in the wall of the coupling member to hold the leg portions in the required position. The inside surface of the sleeve member is however formed identically in shape to the outside surface of the end portion 17C and 17D. As shown in FIG. 6 this shape is square that is it is noncircular to prevent rotation of the end portion 17C and 17D about an axis longitudinal of the leg 17. The square end portions 17C and 17D are formed along a length of the leg 17 only sufficient to extend into the coupling member with the remainder of the wire element being circular in cross section which is readily available in commercial form. The end sections can be stamped into the required square shape by a cold forging system including two dies arranged face to face with each having a V-shaped receptacle to receive the metal from the wire as it is compressed between the two dies. The square shape is arranged so that a diagonal of the square shape lies along a plane 35 which is the plane containing both of the legs of the U-shape.

It will be appreciated that each U-shaped member includes a cross bar (or symmetrical bottom bar) and two depending portions from the cross bar each forming one half of one of the legs of the wire element. The ends of the legs of the U-shaped member can thus be simultaneously stamped into the square shape by laying the leg into two separate V-shaped dies and then applying two upper die parts onto the V-shaped dies to stamp the material into the required square shape. This ensures that the square shapes are aligned with the diagonal line lying directly in the plane containing the two leg portions.

The formation of the wire element with the coupling member allows the wire element to be collapsed into four U-shaped members for flat pack arrangement for purchase and transportation. When opened, however, the U-shaped members can be assembled into the wire construction and will normally be maintained in this condition during the operating life of the device.

Figure 7:
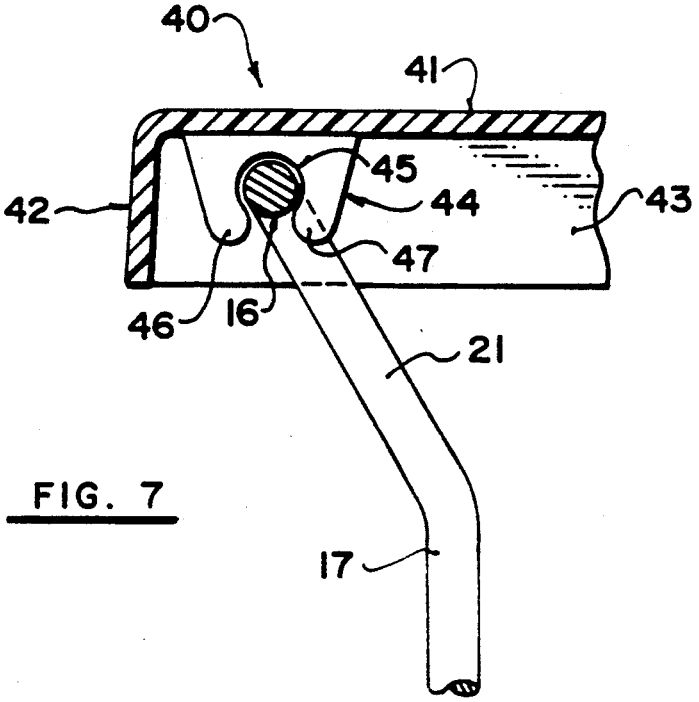
FIG. 7 is a cross-sectional view through an upper part only of the holder of FIG. 1 with a cover element attached.
Figure 8:
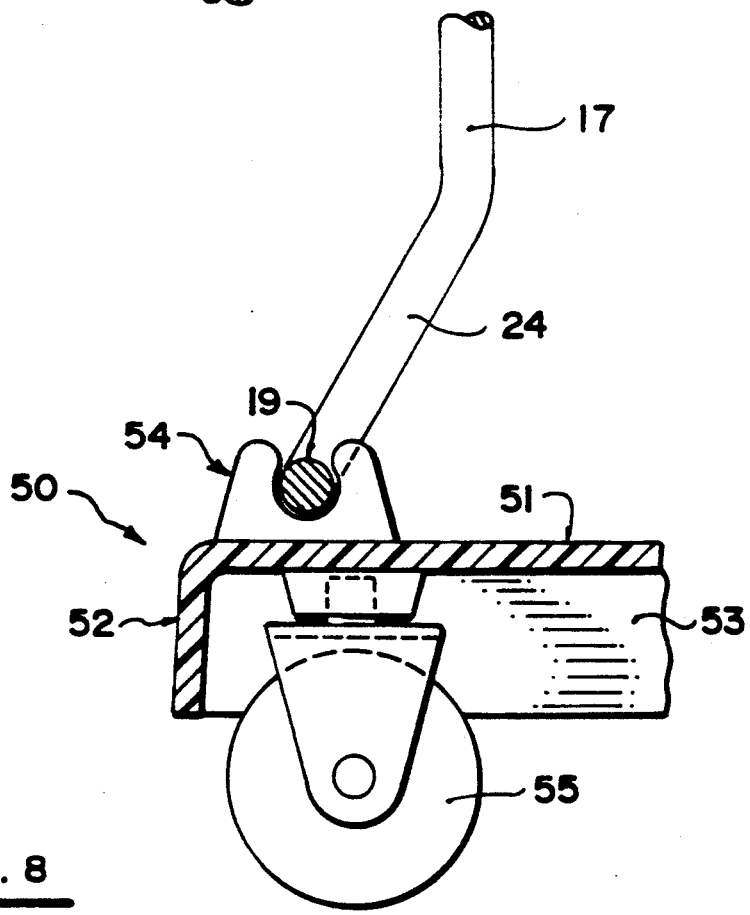
FIG. 8 is a similar cross-sectional view through a lower part only of the holder of FIG. 1 with a base member attached.

In FIGS. 7 and 8 the upper and lower parts of the holder of FIG. 1 are shown with the bag omitted from FIG. 7 for convenience of illustration. In FIG. 7 is shown a cover element 40 comprising a flat cover top panel 41 with depending sides 42 and 43. On the underside of the panel 41 is attached one or more clip fastener elements 44 each defining a channel 45 for receiving and surrounding the top bar 16 as a snap fit retained therein by fingers 46 and 47. In this way the bar 16 can be snapped into place within the channel and then the cover can pivot about a longitudinal axis of the bar 16 by rotation of the element or elements about the surface of the bar. The cover can thus move from a closed position as shown resting on top of the bars 16 and 16A to an open position (not shown) spaced away from the bar 16A for insertion of materials into the bag.

In FIG. 8 is shown a similar arrangement in which a base member 50 includes a base panel 51 and depending sides 52 and 53. On top of the panel is mounted a clip 54 identical to the clip 44 but facing upwardly to receive the bottom bar 19. In this case also the bar 20 will also be clipped (not shown) similarly to the base panel 51. Transport wheels or casters 55 are provided on the underside of the panel 51.

In an alternative arrangement (not shown) the base panel 50 can exclude the castors 55 and can be extended to receive two or more holders each clipped seperately to the panel side by side for example for collection of differing types of waste for recycling.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A garbage bag holder comprising a wire frame shaped and connected to define a substantially continuous wire element including two spaced upstanding bag engaging portions each shaped generally as an inverted U-shaped with an upper cross bar and two depending legs, the cross bars being in spaced generally parallel locations so that an edge of the bag at an open mount of the bag can be wrapped over the cross bars to hold the mouth open, and two bottom bars, each connecting a lowermost end of one leg of one of the bag engaging portions to a lowermost end of an adjacent one of the legs of the other bag engaging portion thus defining four connecting portions each between a respective leg and the respective bottom bar, each of the connecting portions being defined by an integral portion of the wire forming the leg and the bottom bar thus allowing spring flexing of the legs relative to the bottom bars to bias the cross bars apart to stretch the mouth of the bag, each of the legs being separated at a position along its length into two separate leg portions, four connecting members, each connecting together the two separate leg portions of a respective one of the legs, the wire frame thus comprising four separate U-shaped elements connected together by said connecting members, each of two of said U-shaped members comprising one of said cross bars and one separate leg portion of each of two of the legs, and each of two of said U-shaped members comprising one of said bottom bars and one separate leg portion of each of two of the legs, each of said connected members connecting together said two leg portions of a respective one of the legs such that the respective leg is substantially continuous and straight and such that each leg portion is held against rotation relative to the one leg portion of the respective leg about an axis longitudinal of the leg, wherein each connecting portion defines between the respective leg and the respective bottom bar an angle greater than 90° so that the bag engaging portions are inclined upwardly and outwardly away from one another so as to require spring flexing of the bag engaging portions inwardly toward one another to receive the mouth of the bag wrapped therearound, and wherein an upper end of each leg of each bag engaging portion includes an outwardly cranked portion connected to the cross bar such that the cross bars are spaced by a distance greater than a space in between main body portions of adjacent ones of the legs.

2. The holder according to claim 1 wherein the bottom bars are of equal length and are of equal length to the cross bars and wherein the interconnection between the legs and the cross bar and between the legs and the bottom bars is arranged symmetrically so that the wire frame is symmetrical allowing the holder to be inverted for operation in either of the two inverted positions.

3. The holder according to claim 1 wherein each of the U-shaped members is formed of a continuous wire and wherein the connecting members are arranged at a central point along each of the legs so that U-shaped members are all equally dimensioned.

4. The holder according to claim 1 wherein each of the connecting members comprises a sleeve shaped to receive as a press fit abutting ends of the leg portions, the sleeve and the ends of the leg portions being identically shaped and having a non-circular cross section.

5. The holder according to claim 4 wherein the cross section is square with a diagonal of the square lying in a plane containing both of the leg portion of the U-shaped member.

6. The holder according to claim 3 wherein each of the connecting members comprises a sleeve shaped to receive as a press fit abutting ends of the leg portions, the sleeve and the ends of the leg portions being identically shaped and having a non-circular cross section.

7. The holder according to claim 6 wherein the cross section is square with a diagonal of the square lying in a plane containing both of the leg portions of the U-shaped member.

8. A garbage bag holder comprising a wire frame shaped and connected to define a substantially continuous wire element including two spaced upstanding bag engaging portions each shaped generally as an inverted U-shape with an upper cross bar and two depending legs, the cross bars being in spaced generally parallel locations so that an edge of the bag at an open mouth of the bag can be wrapped over the cross bars to hold the mouth open, and two bottom bars, each connecting a lowermost end of one leg of one of the bag engaging portions to a lowermost end of an adjacent one of the legs of the other bag engaging portion thus defining four connecting portions each between a respective leg and the respective bottom bar, each of the connecting portions being defined by an integral portion of the wire forming the leg and the bottom bar thus allowing spring flexing of the legs relative to the bottom bars to bias the cross bars apart to stretch the mouth of the bag, each of the legs being separated at a position along its length into two separate leg portions, four connecting members, each connecting together the two separate leg portions of a respective one of the legs, the wire frame thus comprising four separate U-shaped elements connected together by said connecting members, each of two of said U-shaped members comprising one of said cross bars and one separate leg portion of each of two of the legs, and each of two of said U-shaped members comprising one of said bottom bars and one separate leg portion of each of two of the legs, each of said connecting members connecting together said two leg portions of a respective one of the legs such that the respective leg is substantially continuous and straight, and wherein each of the connecting members comprises a sleeve shaped to receive as a press fit abutting ends of the leg portions, the sleeve and the ends of the leg portions being identically shaped and having a non-circular cross section such that each leg portion is held against rotation relative to the one leg portion of the respective leg about an axis longitudinal of the leg.

9. The holder according to claim 8 wherein the cross section is square with a diagonal of the square lying in a plane containing both of the leg portions of the U-shaped member.

10. A garbage bag holder comprising a wire frame shaped and connected to define a continuous wire element formed from a single length of wire with a single connection between abutting ends of the single length of wire and including two spaced upstanding bag engaging portions each shaped generally as an inverter U-shape with an upper cross bar and two depending legs, the cross bars being in spaced generally parallel locations so that an edge of the bag at an open mouth of the bag can be wrapped over the cross bars to hold the mouth open, and two bottom bars, each connecting a lowermost end of one leg of one of the bag engaging portions to a lowermost end of an adjacent one of the legs of the other bag engaging portion thus defining four connecting portions each between a respective leg and the respective bottom bar, each of the connecting portions being defined by an integral portion of the wire forming the leg and the bottom bar thus allowing spring flexing of the legs relative to the bottom bars to bias the cross bars apart to stretch the mouth of the bag, wherein each connecting portion includes a bend of the wire at an angle slightly greater than 90° so that the bag engaging portions are inclined upwardly and outwardly away from one another so as to require spring flexing of the bag engaging portions inwardly toward one another to receive the mouth of the bag wrapped therearound, wherein each leg of each bag engaging portion includes a main straight leg portion and a cranked portion at an upper end of each main leg portion connected to a respective one of the cross bars and extending in a direction inclined upwardly and outwardly away from the other of the cross bars such that the cross bars are spaced by a distance greater than a space between the main straight leg portions of adjacent ones of the legs, and wherein the bottom bars are of equal length and are of equal length to the cross bars and wherein the interconnection between the legs and the cross bar and between the legs and the bottom bars is arranged symmetrically so that the wire frame is symmetrical allowing the wire frame to be inverted for operation in either of the two inverted positions.

* * * * *